US011661094B2

(12) United States Patent
Spohr et al.

(10) Patent No.: US 11,661,094 B2
(45) Date of Patent: May 30, 2023

(54) REVERSE ANGLED POINT SLIDER

(71) Applicant: Vossloh Signaling USA, Inc., Charlotte, NC (US)

(72) Inventors: Tobin Spohr, Grass Valley, CA (US); Franck Barresi, Région de Strasbourg (FR)

(73) Assignee: Vossloh Signaling USA, Inc., Charlotte, NC (US)

( * ) Notice: Subject to any disclaimer, the term of this patent is extended or adjusted under 35 U.S.C. 154(b) by 256 days.

(21) Appl. No.: 16/418,762

(22) Filed: May 21, 2019

(65) Prior Publication Data

US 2019/0351922 A1 Nov. 21, 2019

Related U.S. Application Data

(60) Provisional application No. 62/674,523, filed on May 21, 2018.

(51) Int. Cl.
*B61L 5/10* (2006.01)
*B61L 5/02* (2006.01)

(52) U.S. Cl.
CPC ..... *B61L 5/107* (2013.01); *B61L 5/026* (2013.01)

(58) Field of Classification Search
CPC .. B61L 5/107; B61L 5/026; B61L 5/10; B61L 5/102; B61L 5/105; B61L 1/00; B61L 1/20; B61L 5/02; B61L 5/065; E01B 7/02; E01B 7/20; E01B 2202/027; E01B 2202/048
See application file for complete search history.

(56) References Cited

U.S. PATENT DOCUMENTS

| | | | | |
|---|---|---|---|---|
| 2,533,929 | A * | 12/1950 | Gray | E01B 7/02 246/435 R |
| 5,192,038 | A * | 3/1993 | Ocampo | B61L 5/107 246/162 |
| 8,684,317 | B2 * | 4/2014 | Arnold | E01B 7/02 246/415 R |
| 9,090,268 | B2 * | 7/2015 | Bohme | E01B 7/02 |
| 9,096,243 | B2 * | 8/2015 | Arnold | E01B 7/02 |
| 9,863,096 | B2 * | 1/2018 | Arnold | E01B 7/20 |
| 2018/0354533 | A1 * | 12/2018 | Palozzi | B61L 5/10 |

FOREIGN PATENT DOCUMENTS

| | | | | |
|---|---|---|---|---|
| EP | 2402505 | A1 * | 1/2012 | E01B 7/02 |
| KR | 20080062496 | A * | 7/2008 | |

* cited by examiner

*Primary Examiner* — Zachary L Kuhfuss
*Assistant Examiner* — Cheng Lin
(74) *Attorney, Agent, or Firm* — Michael G. Monyok

(57) ABSTRACT

A switching apparatus comprising a point detector connecting rod connected at one end to a switch machine and to at least one point at the opposite end. The point detector connecting rod is attached to the point via an angled block that permits a sliding motion relative to the point.

3 Claims, 2 Drawing Sheets

REVERSE ANGLED POINT SLIDER

CROSS-REFERENCE TO RELATED APPLICATIONS

This application claims the benefit under 35 U.S.C. § 119 of Provisional Application Ser. No. 62/674,523, filed May 21, 2018, which is incorporated herein by reference.

STATEMENT REGARDING FEDERALLY SPONSORED RESEARCH

Not applicable.

BACKGROUND OF THE INVENTION

The invention relates to a railroad switch. More specifically, the invention relates to a point slider that accounts for thermal expansion and contraction of rails and points in a railroad switch, allowing proper operation of an indicator.

Points are movable section of rail used to direct a rail car along one of two lines at a junction. For example, a set of points could be used at a junction between a mainline and a branch line that diverges from the mainline. To show which track has been selected and to provide confirmation that complete switching of the points has occurred, an indicator rod is connected at one end to the set of points and to a switch machine or detector at the opposite end. In this configuration, the indicator rod mirrors the movement of the points. These components are used as a point indicator, which is a critical component because if the points are not fully switched, derailment of the train can occur.

Indicator rods are typically connected to the points at a right angle relative to the length of the track and extend beyond the rails to a switch machine, or detector, adjacent to the track. However, the points and other section of rail can expand and contract due to fluctuations in temperature. Any increase in length of the point will cause the angle of connection between the point and indicator rod to deviate from roughly 90 degrees, since the switch machine is in a fixed location and cannot move with the expanding points.

Others have attempted to mitigate the potential misalignment caused by thermal expansion by providing a sliding mechanism at the connection between the point and the indicator rod. However, these attempts have failed to account for the change in the distance between the switch machine and the point as the indicator rod slides along the connection to the point or angled stock rail. That is, a change in length of the distance between the switch machine and point occurs because the point or angled stock rail are tapered and moving along the length of this taper causes the indicator rod to be wedged towards or away from the detector. The length of the indicator rod—or more specifically, the horizontal displacement of the indicator rod along a line perpendicular to the rail—is used to indicate complete switching of the point. As such, a change in length of the indicator rod not related to a horizontal movement of the set of points can become problematic. Therefore, it would be advantageous to develop a point indicator that accounts for thermal expansion while maintaining sensitivity to horizontal displacement.

BRIEF SUMMARY

According to embodiments of the present invention a point indicator mechanism comprising an angled slider at a connection between the point and the indicator rods.

DETAILED DESCRIPTION

Figure 1:
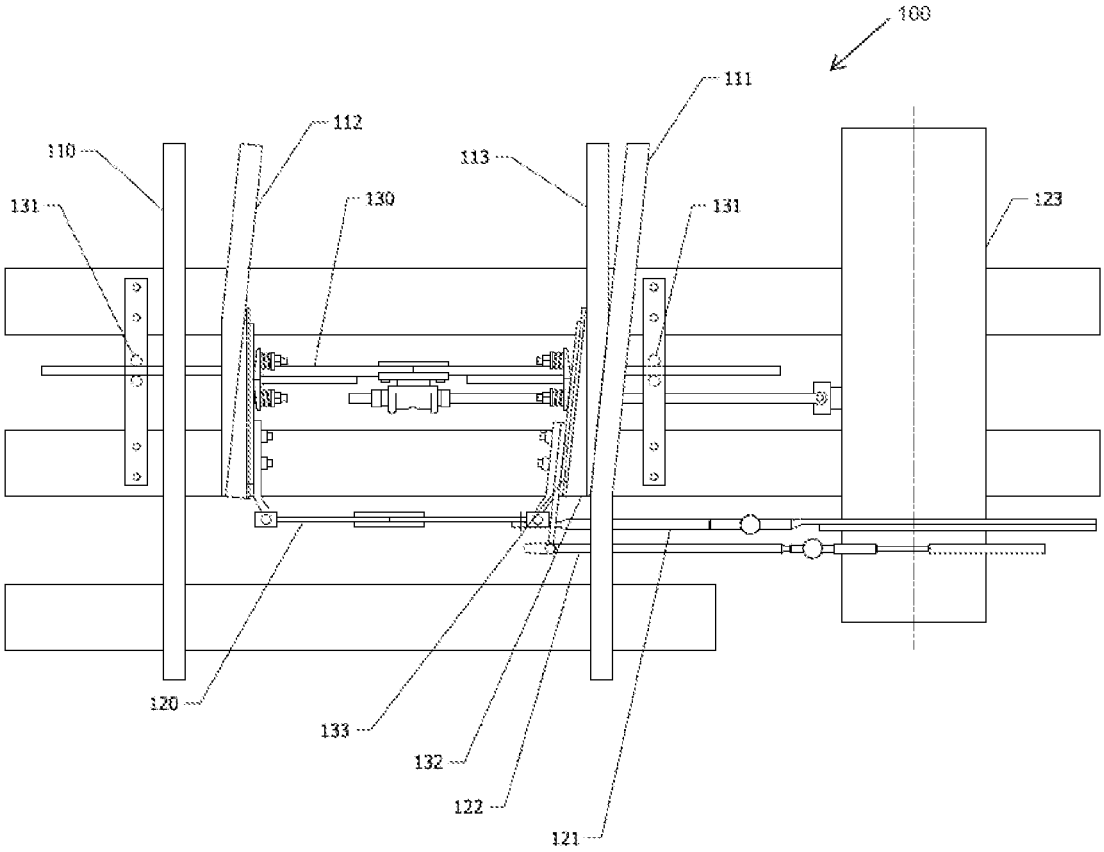
FIG. 1 shows the angled slider according to one embodiment.

FIG. 1 shows a railroad switching apparatus 100 according to one embodiment. As shown in FIG. 1, the switching apparatus 100 comprises a stock rail 110, an angled stock rail 111, a left-hand point 112, a right-hand point 113, a front rod 120, a lockrod connecting rod 121, a point detector connecting rod 122, a switch machine 123, a switch rod 130, a set of rollers 131, and a pair of interconnecting blocks 132, 133. The front rod 120 is connected to the lockrod connecting rod 121, which can be moved in a direction roughly perpendicular to the stock rail 110 by the switch machine 123 to move both the left-hand point 112 and the right-hand point 113. As the points 112, 113 move, the point detector connecting rod 122, which is also connected to the points 112, 113, moves in a similar manner.

Detection of the movement of the point detector connecting rod 122 in the switch machine 123 can be used to indicate the position of the points 112, 113 and whether complete movement of the points 112, 113 has occurred. For example, during a switching movement, a rock from the ballast under the rail ties can be lodged between one of the points 112, 113 and one of the stock rails 110, 111, preventing the points 112, 113 from sitting flush against the stock rails 110, 111. If the gap is sufficiently large, a railcar risks derailing as is passes through the switch 100. The point detector connecting rod 122 is used to help identify such a condition before the railcar passes through the switch 100.

In certain situations, thermal expansion of the points 112, 113 can cause misalignment of the point detector connecting rod 122. For example, as the points 112, 113 move in a direction parallel to the stock rails 110, 111 due to thermal expansion or from the flange of train wheels pushing the points 112, 113, one of the points 112, 113 will slide along the stock rail 110 or angled stock rail 111. In the embodiment shown in FIG. 2, the right-hand point 113 is sliding on the angled stock rail 111. As the point 113 moves along the angled stock rail 111, it experiences a displacement towards the stock rail 110 (i.e. towards the center of the track) caused by the angle or taper of the tapered stock rail 111.

In a typical switching apparatus, the switch rod, front rod, point detector connecting rod and lock rod connecting rod would be bolted directly to the points themselves; as a result, in a typical switch apparatus, when the point experiences movement in a direction parallel to the stock rail, the switch rod, front rod, point detector connecting rod and lock rod connecting rod would move wherever the point moves. This typical movement could have two negative effects on the point detector connecting rod and lock rod connecting rod. First, the rods could lose their intended angular alignment in relation to the switch machine causing a loss of "indication"; and second, the rods could displace horizontally in relation to the switch machine causing a loss of "indication".

Figure 2:
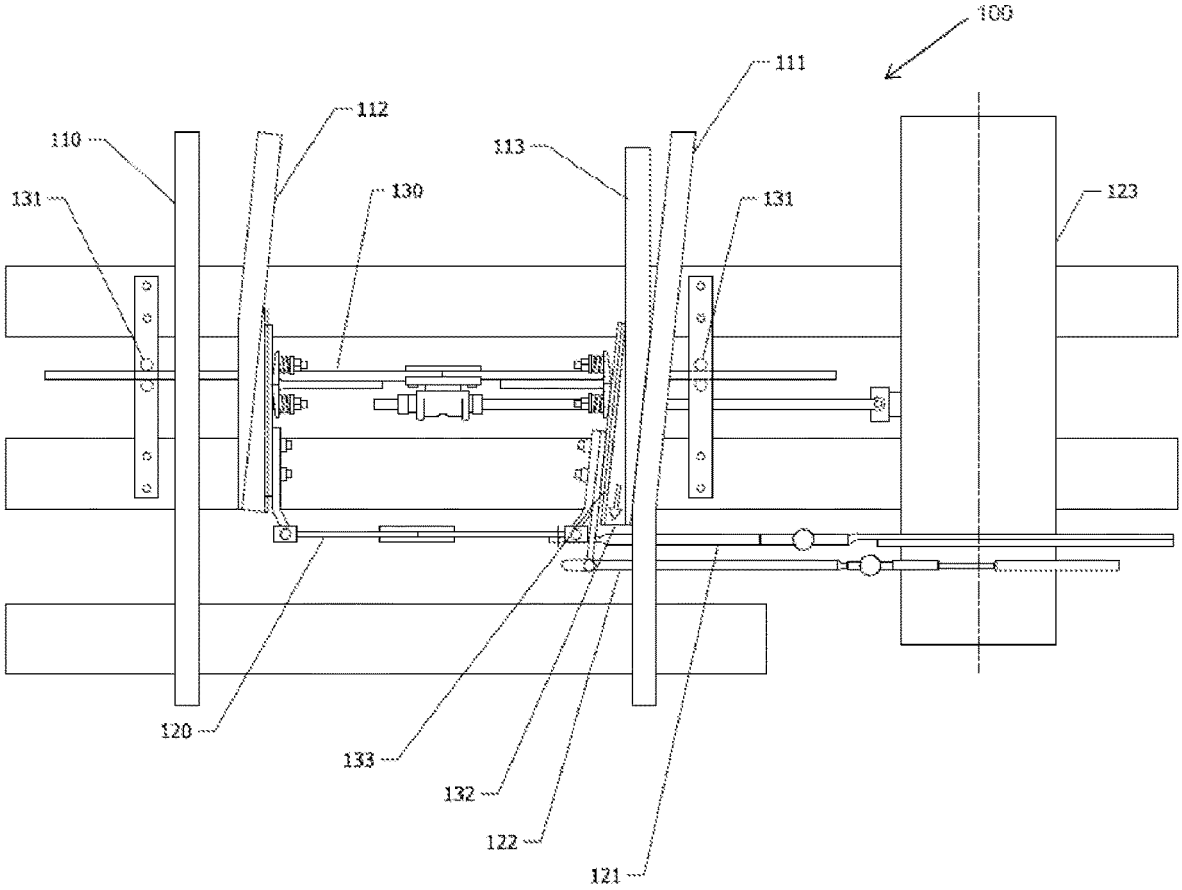
FIG. 2 is an alternative view of the angled point slider.

FIG. 1 shows the switch 100 with the points 112, 113 in a first position. FIG. 2 shows the switch 100 with the point 113 extended along stock rail 111 due to thermal expansion, for example. As shown in FIGS. 1-2, the reverse angled point slider of the present invention eliminates both negative effects by allowing the points 112, 113 to move in a direction parallel to the stock rails 110, 111 while holding the switch rod 130, front rod 120, point detector connecting rod 122, and lock rod connecting rod 121 from moving in relation to the switch machine 123 by use of guide rollers 131, female dovetail blocks 132, and male dovetail blocks 133. The term 'dovetail' is used to describe a female slot that captures a male rail, where the male rail is adapted to slide back and forth within the female slot. While dovetail blocks 132, 133 are depicted in this example embodiment, block of varying shape that allow one block to slide within the other can be used.

Referring again to FIGS. 1-2, the female dovetail block 132 is bolted to each point 112, 113 and is cut or manufactured so that the sliding surface is parallel to the stock rail 110, 111 while the point is closed. The male dovetail block 133 is inserted inside the female dovetail 132 and allowed to slide freely. The switch rod 130 and front rod 120 are both bolted to the male dovetail block 132. The switch rod 130 is then prevented from moving in a direction along the stock rails 110, 111 by way of guide roller assemblies 131. The guide rollers 131 allow the switch rod 130 to be pushed side to side by the switch machine 123. Since the switch rod 130 and the front rod 120 are both bolted to the male dovetail blocks 133, the front rod 120, point detector connecting rod 122, and lock rod connecting rods 121 are prevented from moving in a direction along the stock rails 110, 111. Preventing this movement counteracts misalignment in relation to the switch machine 123. The reverse angle of the female dovetail block counteracts the left or right movement of the switch rod 130, front rod 120, point detector connecting rod 122, and lock rod connecting rod 121, thereby preventing horizontal displacement.

While the disclosure has been described in detail and with reference to specific embodiments thereof, it will be apparent to one skilled in the art that various changes and modification can be made therein without departing from the spirit and scope of the embodiments. Thus, it is intended that the present disclosure cover the modifications and variations of this disclosure provided they come within the scope of the appended claims and their equivalents.

What is claimed is:

1. A switching apparatus including a point indicator comprising:

an angled stock rail, a movable point, a switch rod for switching the movable point between an open position and a closed position, an indicator rod connected to the movable point by a pair of interconnecting blocks slidably engaged with each other, wherein a first interconnecting block of the pair of interconnecting blocks is connected to the movable point and has a sliding surface parallel to the angled stock rail where the angled stock rail contacts the movable point, and wherein a second interconnecting block of the pair of interconnecting blocks is connected to the switch rod.

2. The switching apparatus of claim 1, wherein the pair of interconnecting block comprises:

a female dovetail block, and a male dovetail block disposed inside the female dovetail block.

3. The switching apparatus of claim 1, further comprising:

a guide roller in a fixed position relative to the angled stock rail, wherein the switch rod engages the guide roller to permit movement perpendicular to the angled stock rail and prohibit movement parallel to the angled stock rail.

* * * * *